US007185888B2

(12) United States Patent
Duff et al.

(10) Patent No.: US 7,185,888 B2
(45) Date of Patent: Mar. 6, 2007

(54) ROTATIONAL JAM CLEARANCE APPARATUS

(75) Inventors: David G. Duff, Woodside, CA (US); David K. Biegelsen, Portola Valley, CA (US); Lars-Erik Swartz, Sunnyvale, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 439 days.

(21) Appl. No.: 10/812,376

(22) Filed: Mar. 29, 2004

(65) Prior Publication Data

US 2005/0212199 A1 Sep. 29, 2005

(51) Int. Cl.
*B65H 39/10* (2006.01)
*B65H 29/00* (2006.01)
*B65H 5/00* (2006.01)

(52) U.S. Cl. ..... 271/303; 271/185; 271/225

(58) Field of Classification Search ..... 271/185, 271/303, 225; 400/462, 642; 399/124, 16, 399/18, 20, 21
See application file for complete search history.

(56) References Cited

U.S. PATENT DOCUMENTS 4,783,678 A * 11/1988 Honda et al. ..... 399/124
4,871,163 A * 10/1989 Landa et al. ..... 271/225
5,020,789 A * 6/1991 Droge et al. ..... 271/225
5,095,342 A 3/1992 Farrell et al. ..... 355/319
5,159,395 A 10/1992 Farrell et al. ..... 355/319
5,367,363 A * 11/1994 Kai et al. ..... 399/113
5,557,367 A 9/1996 Yang et al. ..... 355/202
5,614,992 A * 3/1997 Kikuchi et al. ..... 399/124
6,010,127 A 1/2000 DiCesare et al. ..... 271/259
6,125,251 A * 9/2000 Shiraishi et al. ..... 399/124
6,139,011 A 10/2000 Huang et al. ..... 271/274
6,647,228 B2 11/2003 Nakamura et al. ..... 399/124
2001/0014246 A1* 8/2001 Luciano et al. ..... 400/693
2004/0086285 A1* 5/2004 Yoshikawa ..... 399/13
2005/0167903 A1* 8/2005 Hartl et al. ..... 271/2

* cited by examiner

*Primary Examiner*—Patrick Mackey
*Assistant Examiner*—Mark Hageman
(74) *Attorney, Agent, or Firm*—Linda M. Robb

(57) ABSTRACT

A media path jam clearance apparatus installable in a supporting structure includes media drive mechanisms for moving flexible media through media paths and a rotatable, removable jam clearance element. Within the jam clearance element facing surfaces of guide elements define guide surfaces for media paths, with the guide elements having external surfaces capable of supporting the flexible media as it is wrapped around the external surfaces. A pivotal support element supports and enables rotational movement of the jam clearance element within the supporting structure. The jam clearance element may be partially or entirely extracted from the supporting structure.

25 Claims, 10 Drawing Sheets

ROTATIONAL JAM CLEARANCE APPARATUS

CROSS REFERENCE TO RELATED APPLICATIONS

The following copending applications, U.S. application Ser. No. 10/357,687, filed Feb. 4, 2003, titled "Media Path Modules", U.S. application Ser. No. 10/357,761, filed Feb. 4, 2003, titled "Frameless Media Path Modules", and U.S. application Ser. No. 10/740,705, filed Dec. 19, 2003, titled "Flexible Director Paper Path Module", are assigned to the same assignee of the present application. The disclosures of these copending applications are totally incorporated herein by reference in their entirety.

INCORPORATION BY REFERENCE

The following U.S. patents are fully incorporated herein by reference: U.S. Pat. No. 6,010,127 ("Internal Purge for Easy Jam Clearance in Copiers/Printers"); U.S. Pat. No. 6,139,011 ("Jam clearance for Printer Path by Manual Operation"); and U.S. Pat. No. 6,647,228 ("Image Forming Device").

BACKGROUND

This disclosure relates generally to the field of flexible media handling, and more particularly to an improved apparatus for the clearance of jammed media in a media path.

Paper transport systems within printing systems are generally constructed from custom designed units, usually consisting of heavy frames supporting pinch rollers driven by one or a few motors. Such systems utilize a plurality of copy sheet drives, pinch rollers, and belts to transport paper through the printer system. However, these systems are custom designed to meet the differing needs of specific printing environments for specific printing demands, which renders field reconfigurability and programmable reconfigurability unachievable.

Another approach to system design is the creation of printing systems having multiple modules, possibly having varying capabilities, linked by multiple paper paths to each other and to various output and finishing operations. Because such systems would result in densely populated paper paths, easy inexpensive jam clearance is a major design goal. Sheets traversing such paths would always be in contact with at least two, and as many as four media-handling nips. Clam shell designs which are frequently used to open entire sections of standard paper paths are generally no longer viable due to space restrictions. In multiple module systems the clearance problem can be still more complex due to the meandering paths that sheets are allowed to follow, presenting a need for improved methods for media jam clearance.

Accordingly, it is desirable to provide a system and method for creating highly configurable and high-performance paper transport systems which provide an improved approach for media jam clearance.

BRIEF SUMMARY

The disclosed embodiments provide examples of improved solutions to the problems noted in the above Background discussion and the art cited therein. There is shown in these examples an improved media path jam clearance apparatus installable in a supporting structure. The jam clearance apparatus includes media drive mechanisms for moving flexible media through media paths and a rotatable, removable jam clearance element. Within the jam clearance element facing surfaces of guide elements define guide surfaces for media paths, with the guide elements having external surfaces capable of supporting the flexible media as it is wrapped around the external surfaces. A pivotal support element supports and enables rotational movement of the jam clearance element within the supporting structure. The jam clearance element may be partially or entirely extracted from the supporting structure.

In another embodiment there is provided a media handling system including media handling modules of various types, input modules, output modules, and rotatable, removable media path jam clearance apparatuses. The jam clearance apparatuses are installable within a substantially rigid supporting structure. Each jam clearance apparatus includes media drive mechanisms for moving flexible media through media paths and a jam clearance element. Within the jam clearance element facing surfaces of guide elements define guide surfaces for media paths, with the guide elements having external surfaces capable of supporting the flexible media as it is wrapped around the external surfaces. A pivotal support element supports and enables rotational movement of the jam clearance element within the supporting structure. The jam clearance element may be partially or entirely extracted from the supporting structure.

In yet another embodiment there is provided a method for operating a rotatable, removable media path jam clearance apparatus installable within a substantially rigid supporting structure. The media path jam clearance apparatus includes a jam clearance element, media drive mechanisms and guide baffles. The method includes driving at flexible media through a media path located within the media path jam clearance element. The media path is defined by guide elements having facing surfaces defining the media path and external surfaces capable of supporting the flexible media as it is wrapped around the external surfaces. Guide baffles are retracted to a position sufficient to prevent interference with rotational movement of the jam clearance element within the supporting structure. The jam clearance element is rotated about a pivotal support within the supporting structure when flexible media has become jammed in the media path, so that a captured unit of flexible media is wrapped around the external surfaces of the guide elements. The jam clearance element is then partially or fully extracted from the supporting structure in a direction perpendicular to the process direction.

BRIEF DESCRIPTION OF THE DRAWINGS

The foregoing and other features of the embodiments described herein will be apparent and easily understood from a further reading of the specification, claims and by reference to the accompanying drawings in which:

DETAILED DESCRIPTION

The rotational apparatus for media jam clearance in complex systems utilizes a rotatable jam clearance element, which enables jammed sheet extraction through spindling the jammed medium around a rotatable jam clearance element to collect the sheet around a single element. The spindled medium and the jam clearance element are then slipped out of the machine perpendicular to the process direction, followed by process direction removal of the medium from the jam clearance element.

Figure 1:
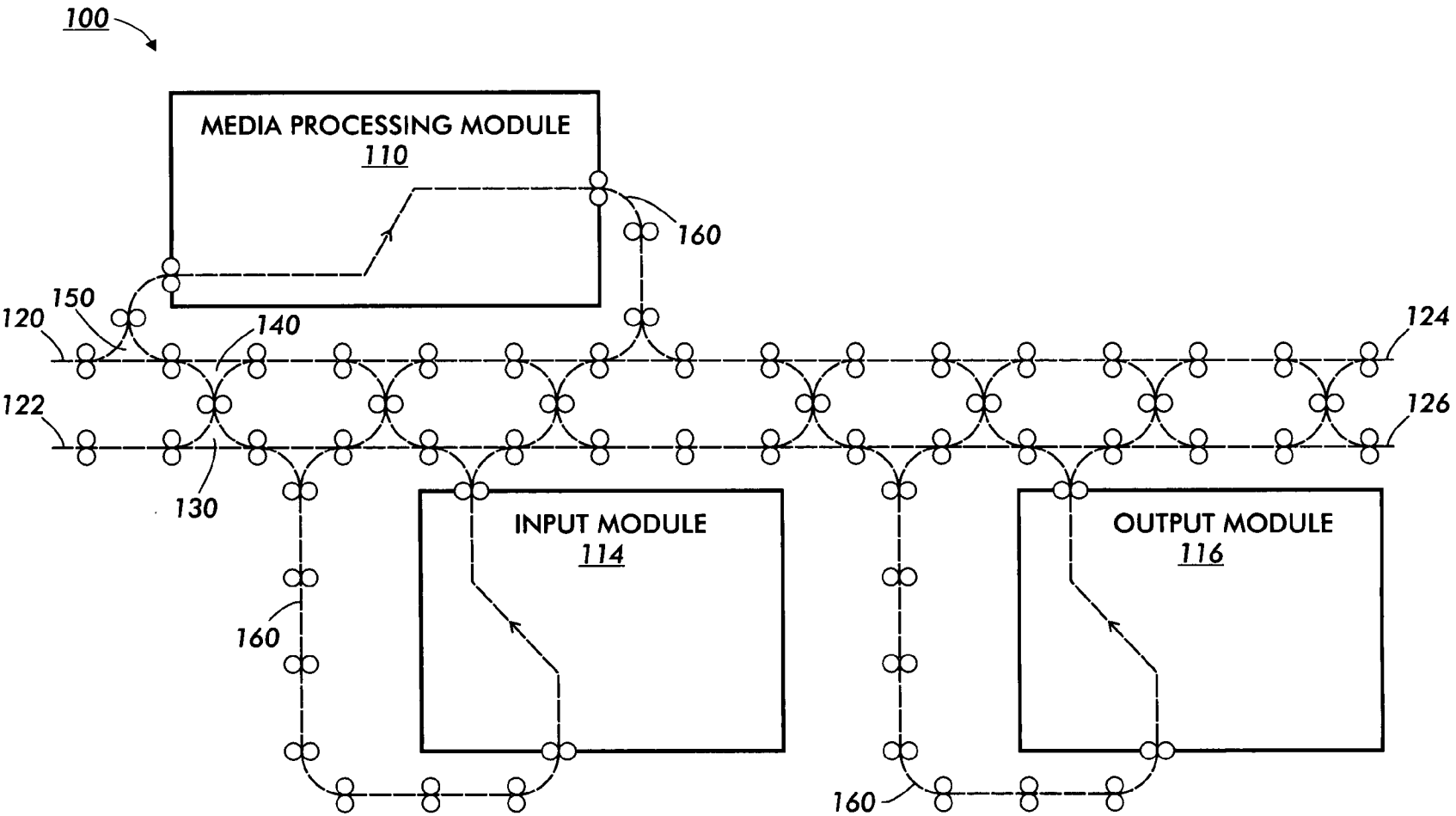
FIG. 1 is a schematic representation of an example embodiment of a print system utilizing the jam clearance apparatus described herein.

Such jam clearance elements may be used to provide jam clearance for a variety of flexible media, for example sheets of paper or cardboard. Use of the jam clearance elements beneficially eliminates the need for expensive, custom-designed media transport systems by allowing such media transport systems to be created from standardized subunits, as described in co-owned, co-pending U.S. patent application Ser. No. 10/357,687, filed Feb. 4, 2003, titled "Media Path Modules", and Ser. No. 10/357,761, filed Feb. 4, 2003, titled "Frameless Media Path Modules", incorporated by reference. According to one embodiment, for example a printing system, complex media routing requirements can be satisfied by linking multiple jam clearance elements in a single media handling system 100, as shown in FIG. 1. Media handling system 100 includes example jam clearance elements 130, 140, and 150, each of which is described more fully with reference to FIG. 2 hereinbelow. Note that according to an embodiment of the media handling system, the jam clearance elements may have different orientations, as shown by jam clearance element 140, which is inverted relative to jam clearance elements 130 and 150. Additionally, while for the purposes of illustration the jam clearance elements are shown as being approximately identical, it will be appreciated by one skilled in the art that various jam clearance elements configurations could be combined in a single media transport system. For example, jam clearance elements having one, two, three, or more media paths could all be utilized in a single media transport system in various arrangements to satisfy media flow requirements.

Example media handling system 100 also includes media processing module 110, input module 114, and output module 116, as well as control means consisting of electronics and software for directing the movement of media along paper paths 120, 122, 124, and 126. Media processing module 110 may encompass machines having similar or differing performance capabilities, for example various black and white and color print engines. While for the purposes of this embodiment a single media processing module is illustrated, it will be appreciated that multiple media processing modules may be included in such a system. Media paths 120 and 122 may receive print media from paper supplies (not shown), other media processing modules, or other input modules, while media paths 124 and 126 transport media to finishing equipment such as stapling, binding, sorting, and stacking devices, other media processing modules, or other output modules. To illustrate the configurational flexibility associated with media paths constructed with combinations of jam clearance elements and media path segments, an open system, to which other elements may be operatively attached, is shown.

As seen in FIG. 1, system 100 also includes inter-linking path segments 160 between the jam clearance elements and the print engines. The combination of jam clearance elements and inter-linking path segments provides a simple means for constructing a media handling system that can selectively provide media from different sources to various print engines. Inter-linking path segments 160 may also include rotational jam clearance capability. While media paths between the various print engines are described for exemplary purposes, the jam clearance elements and inter-linking path segments can be used to provide configurable media paths between any type and arrangement of media stations (e.g., paper supplies, print engines, staging areas, reader systems, and binding systems, among others) having various media entry and exit ports.

Figure 2:
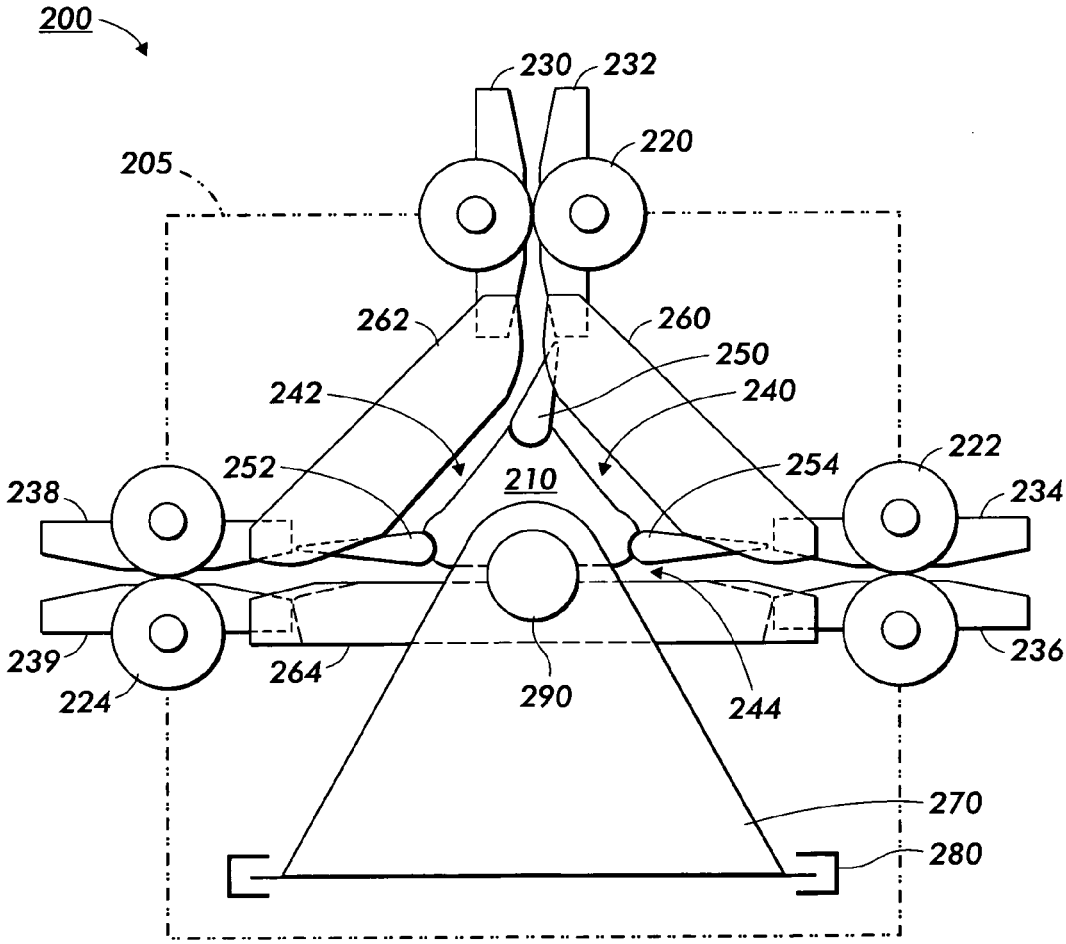
FIG. 2 illustrates one example embodiment of the jam clearance element.

Turning now to FIG. 2, an example embodiment of jam clearance apparatus 200 consists of two major removable submodules: nip drives with sheet state sensors and a jam clearance element, both of which are included within a frame 205. The nip drives include pinch rollers 220, 222, and 224, and nip baffle pairs 230, 232, 234, 236, 238, and 239. Frame 205 may comprise any substantially rigid structure that provides support for the components of the nip structure and the jam clearance element (e.g., a backplane, a mounting plate, or device housing, among others). Various attachment methods known in the art may be used to assemble jam clearance apparatus 200 to other jam clearance apparatuses or to other elements in a larger media handling system. The two parts of nip baffle pairs 230, 232, 234, 236, 238, and 239 are interdigitated to facilitate non-stubbing sheet transfer in either direction. The nip baffles, as described herein are retractable and director element 210 is rotatable.

The jam clearance element according to this example embodiment includes side baffles 260 and 262, and bottom baffle 264, positioned in relationship to director element 210 to form media paths. With director element 210, side baffle 260 defines media path 240; director element 210 and side baffle 262 define media path 242; and director element 210 and bottom baffle 264 define media path 244. While three media paths are shown for the purposes of this example embodiment, the jam clearance element may define any number of media paths, as will be appreciated by one skilled in the art. For example, the jam clearance element may have input/output configurations in the form of a straight through path or a fixed ninety-degree turn. Alternatively, the jam clearance element may include a four input/output configuration. Pinch rollers 220, 222, and 224 drive flexible media into and out of media paths 240, 242, and 244. While pinch rollers are depicted as media driving elements for the purposes of this embodiment, a jam clearance apparatus can include any other driving means, including spherical nip actuators (as described in U.S. Pat. No. 6,059,284 to Wold et al.), airjets, or piezoelectrically driven brushes (as described in U.S. Pat. No. 5,467,975 to Hadimioglu et al.).

Director element 210 includes means for providing access to and egress from a selected one of media paths 240, 242, or 244. For the purposes of this embodiment a set of articulating tips 250, 252, and 254, which move relative to the body of director are illustrated, with operation of such a director element described more fully in Ser. No. 10/740, 705, titled "Flexible Director Paper Path Module", incorporated by reference hereinabove. It will be noted that while for the purposes of this embodiment articulating tips are illustrated, director element 210 may utilize various structures known in the art or later invented for providing access to and egress from a selected media path.

Baffles 260, 262, and 264 and director element 210 are supported within frame 205 by support structure 270 capable of movement in sliding support 280 to permit removal of the director element 210 from the machine. Baffles 260, 262 and 264, and director element 210 are supported between two end caps (not shown) which maintain their spatial relationship as well as provide pivotal support for articulating tips 250, 252 and 254. A manipulatable feature, for example a handle (not shown), may be attached to the front of the end cap. This assembly forms the jam clearance element. Pivotal support of the jam clearance unit in cradle 290 enables sheets caught within multiple jam clearance elements to be spindled onto the jam clearance element having a central director 210 (with or without active assistance of the nip drives involved) until the entire sheet is wrapped around the external surfaces of baffles 260, 262, and 264 of the jam clearance element and lies entirely within the chosen module. Then the jam clearance element is removed from the machine and the sheet is extracted by unrolling and pulling the media parallel to the process direction. Nip baffles 234, 236, 238, 239, director baffles 260, 262 and 264, director element 210 comprise any substantially rigid structure and may be fabricated, for example, from an injection molded plastic such as ABS, with bent steel sheet metal reinforcing elements. It will be appreciated that various other configurations are possible for the jam clearance element. For example, the director element may include a shaft that fully impales the director element core and acts as both rotary axis and drawer slide.

Figure 3:
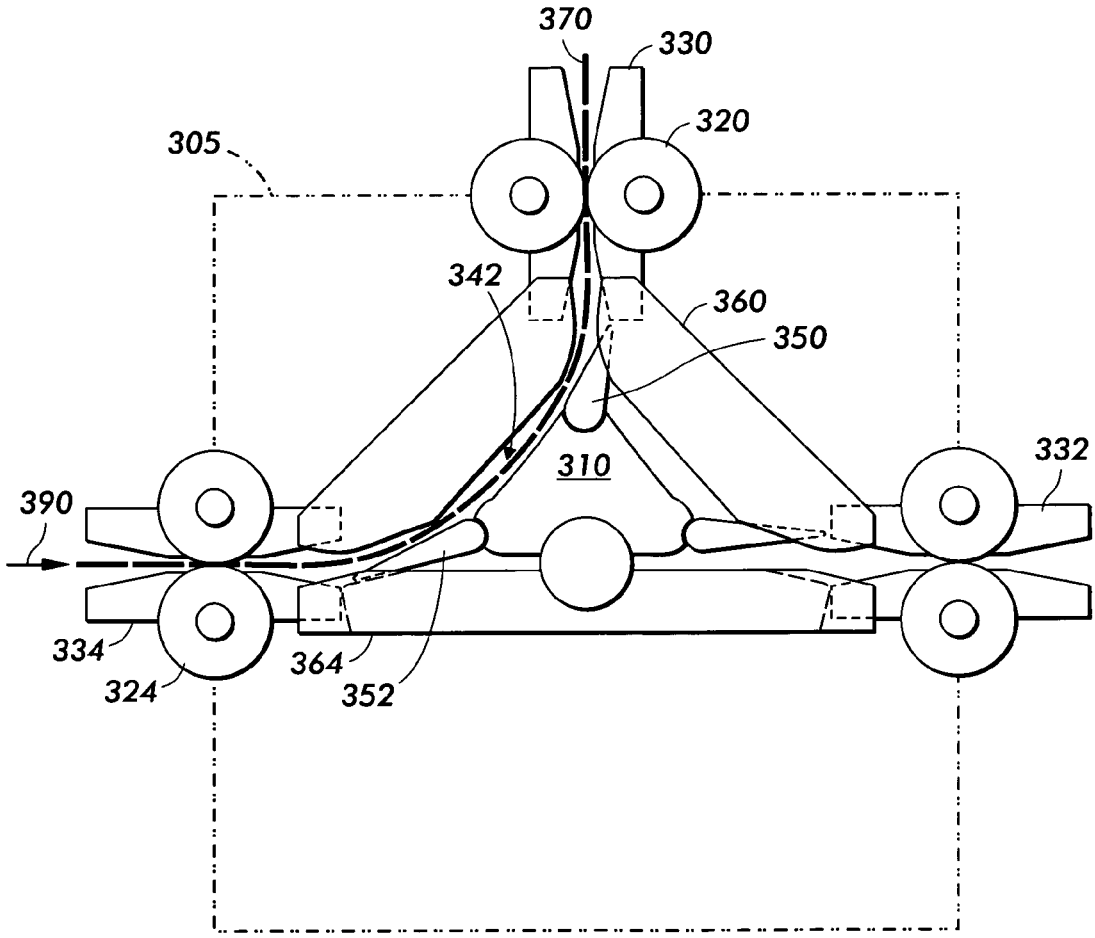
FIG. 3 illustrates the movement of media into the jam clearance element from adjoining sides of the mechanism.

Turning now to FIG. 3, within frame 305, director element 310's articulating tip 352 is rotated towards bottom baffle 364, while articulating tip 350 is rotated toward side baffle 360. Nip baffle pairs 330, 332, and 334 are in a fully extended position to permit media flow through media path 342 in a curvilinear direction. Pinch rollers 324 and 320 can then drive media 370 through media path 342 in a transport direction 390. Note that the media could also be driven in the opposite direction (i.e., the reverse of transport direction 390).

Figure 4:
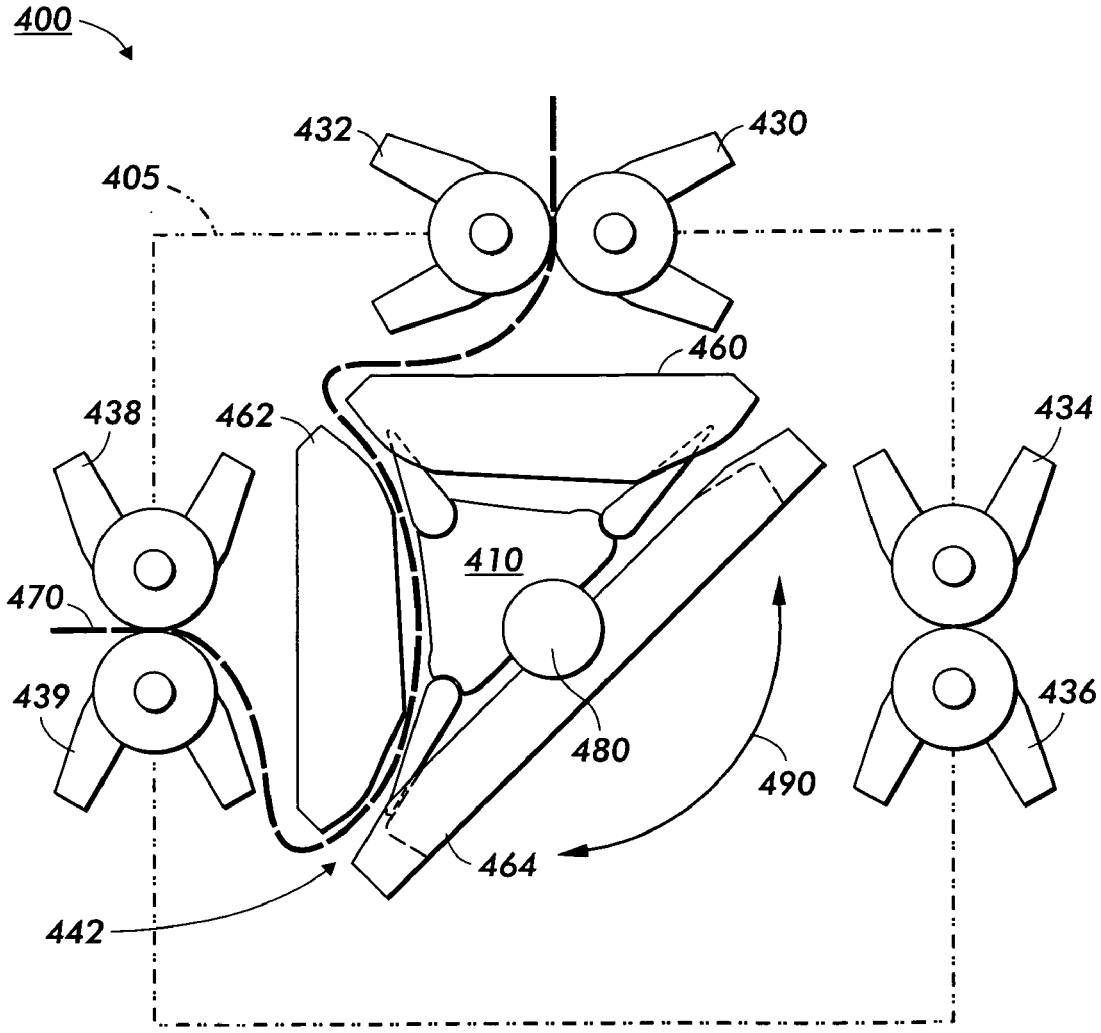
FIG. 4 illustrates initial rotation of the jam clearance element in capturing jammed media.

In FIG. 4, director element 410, side baffles 460 and 462, and bottom baffle 464 have been rotated about pivotal support 480 of jam clearance element 400, according to rotational process direction 490. To enable such rotation, nip baffle pairs 430, 432, 434, 436, 438, and 439 have been retracted to a position sufficient to prevent interference with rotational movement of side baffles 460 and 462 and bottom baffle 464. The rotational movement causes media 470, which is moving through media path 442, to be pulled into the internal portion of frame 405 and to begin to wrap around the external surface of side baffle 460.

Figure 5:
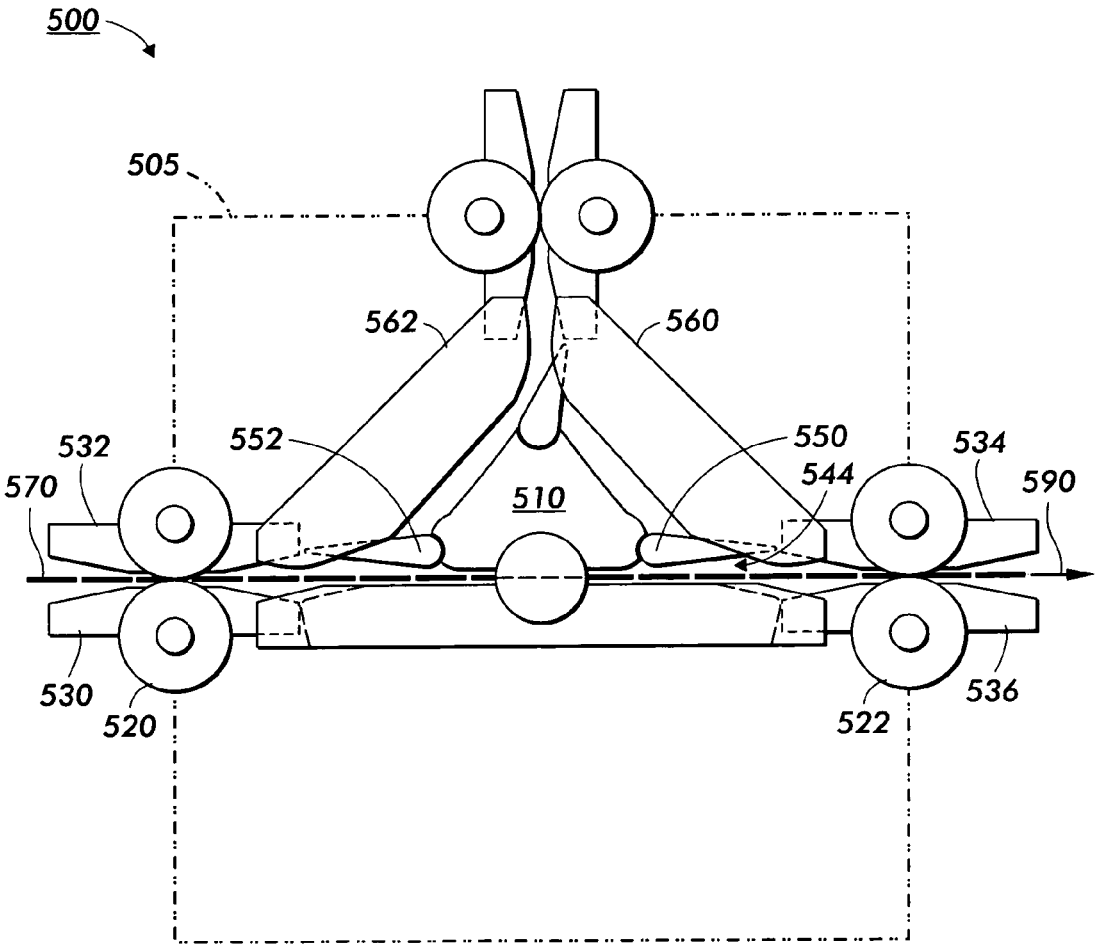
FIG. 5 illustrates the movement of media into the jam clearance element from opposing sides of the mechanism.

In FIG. 5 media 570 moves through media path 544 in a linear transport direction through jam clearance apparatus 500. Within frame 505, director element 510's articulating tip 550 is rotated towards side baffle 560, while articulating tip 552 is rotated toward side baffle 562. Nip baffle pairs 530, 532, 534, and 536 are in a fully extended position to permit media flow, driven by pinch rollers 522 and 520 through media path 544 in transport direction 590. Note that the media could also be driven in the opposite direction (i.e., the reverse of the transport direction).

Figure 6:
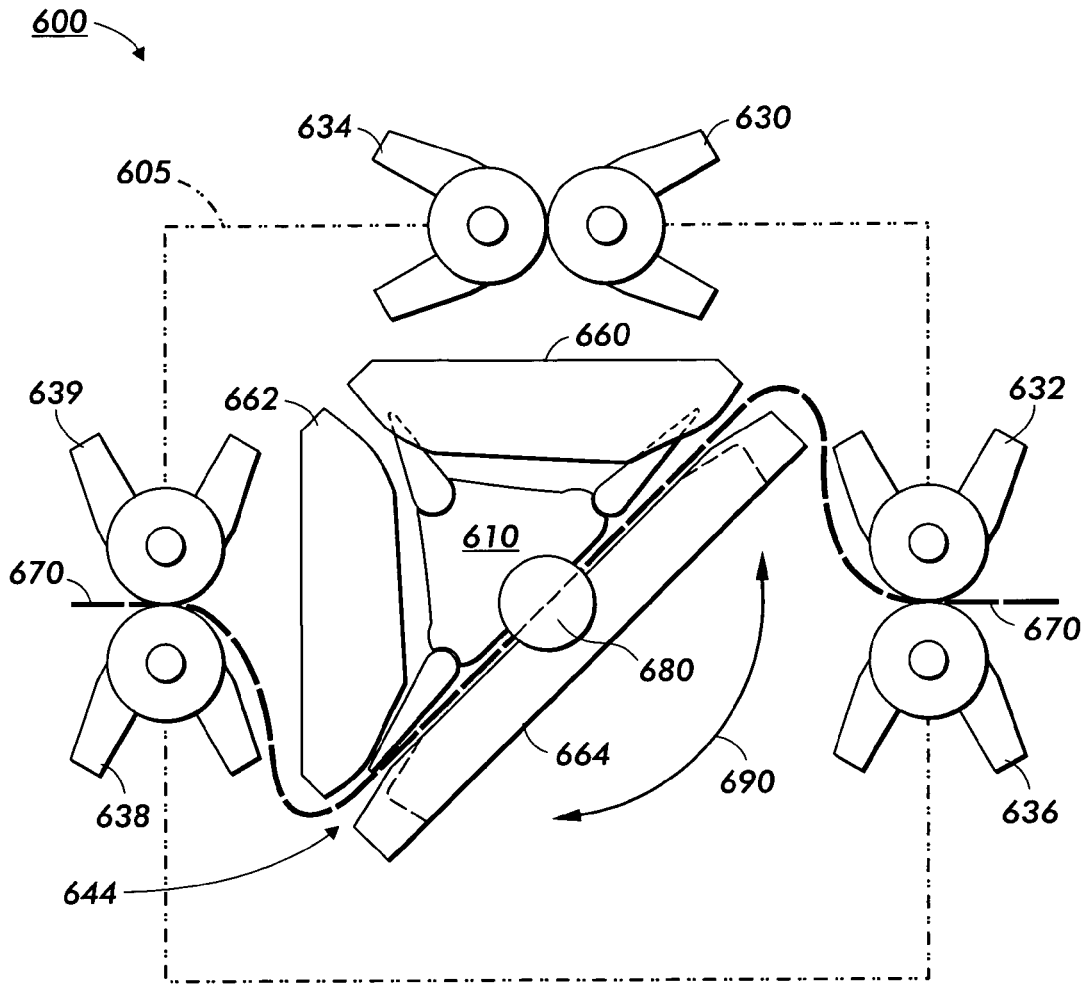
FIG. 6 illustrates initial rotation of the jam clearance element in capturing jammed media.

Turning now to FIG. 6, director element 610, side baffles 660 and 662, and bottom baffle 664 have been rotated about pivotal support 680 of jam clearance element 600, according to rotational process direction 690. To enable such rotation, nip baffle pairs 630, 632, 634, 636, 638, and 639 have been retracted to a position sufficient to prevent interference with rotational movement of side baffles 660 and 662 and bottom baffle 664. The rotational movement causes media 670, which is moving through media path 644, to be pulled into the internal portion of frame 605 and to begin to wrap around the external surface of side baffle 662.

Figure 7:
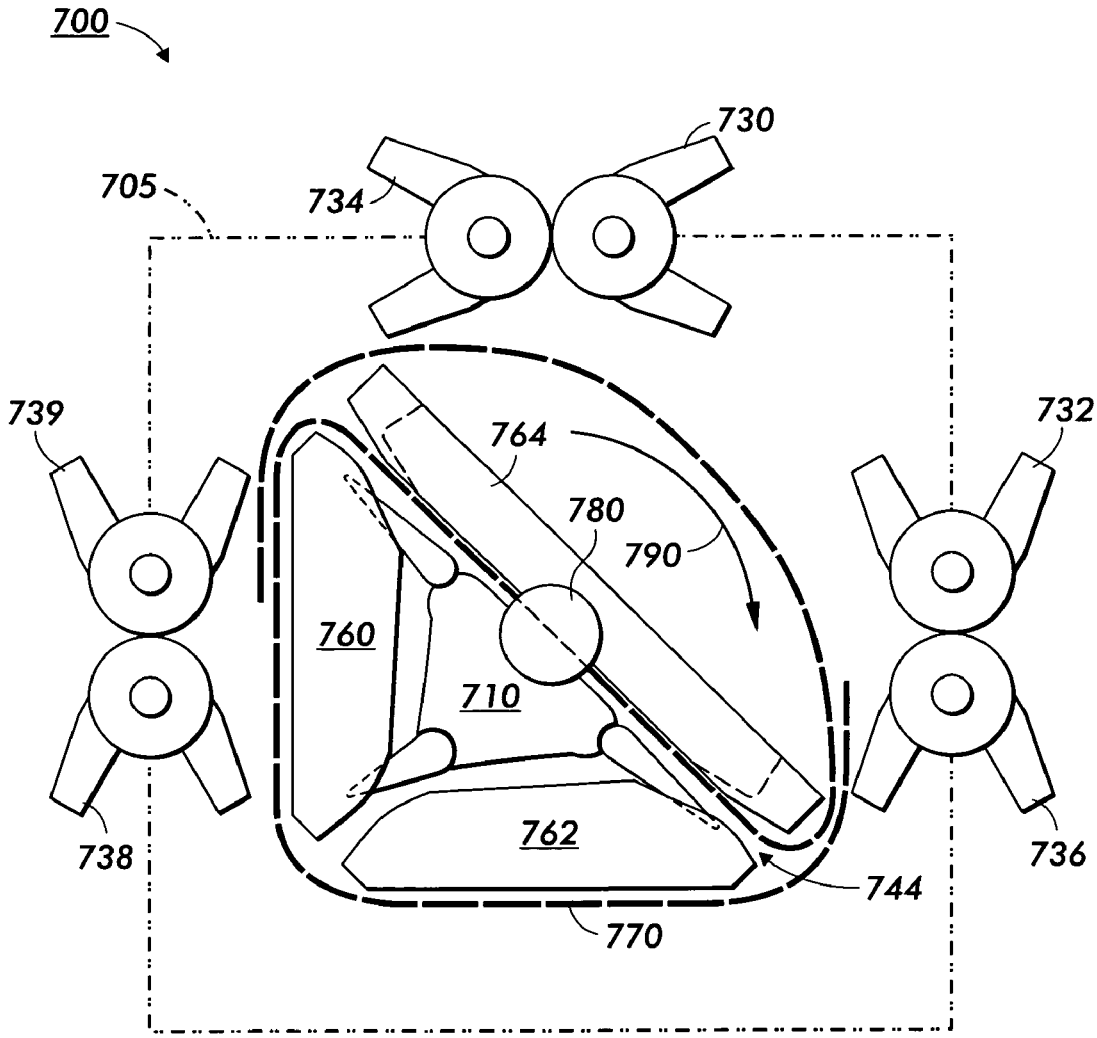
FIG. 7 illustrates completed rotation of the jam clearance element with the media captured within the clearance mechanism.

In FIG. 7, director element 710, side baffles 760 and 762, and bottom baffle 764 have been rotated further about pivotal support 780 of jam clearance element 700, according to rotational process direction 790. Nip baffle pairs 730, 732, 734, 736, 738, and 739 have remained retracted to a position sufficient to prevent interference with rotational movement of side baffles 760 and 762 and bottom baffle 764. Because of the rotational movement, media 770, which originally was moving through media path 744, has completely wrapped around the external surfaces of the side and bottom baffles within the internal portion of frame 705. At this point the baffles and director can be pulled forward from the machine and the sheet can be unwound and removed.

Figure 8:
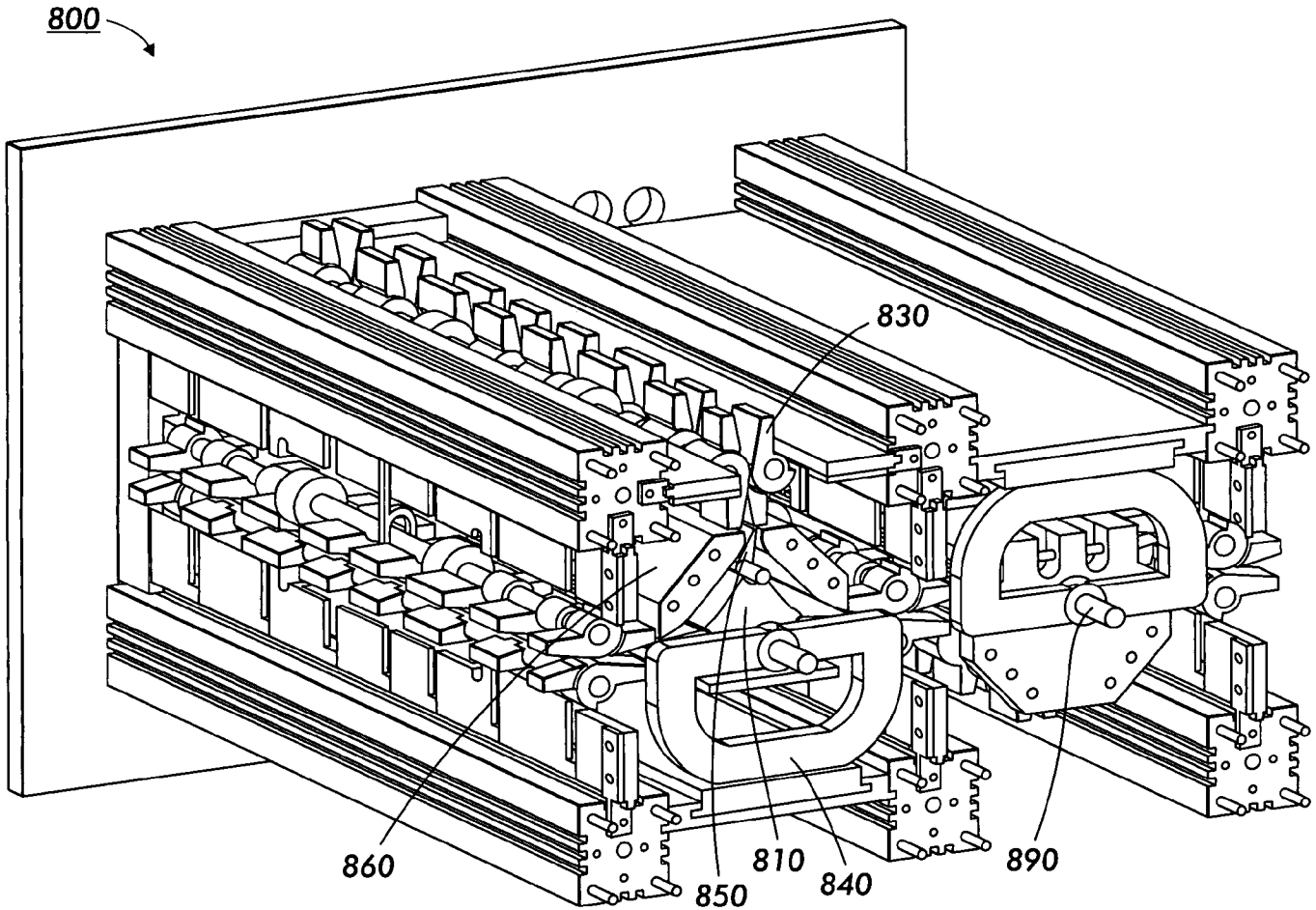
FIG. 8 is a three-dimensional rendering of an example embodiment of an assembly utilizing two jam clearance elements.

FIG. 8 further illustrates features of an example embodiment for an assembly of the jam clearance elements. Here multiple element assembly 800 includes two jam clearance elements in inverted adjacent relationship to each other. As can be observed more clearly in this view, nip baffles 830 are interdigitated with articulating tips 850. With the nip baffles of the three nip drives retracted, media can be spindled around the rotating director 810 and side baffles 860 without shredding through interfering interdigitated articulating tips. Director element 810 and side baffles 860 are rotated about pivot structure 890, using handle 840, until the entire sheet is wrapped around the director element and side baffles. Handle 840 is then pulled to slide the director element and jammed sheet from the machine.

Figure 9:
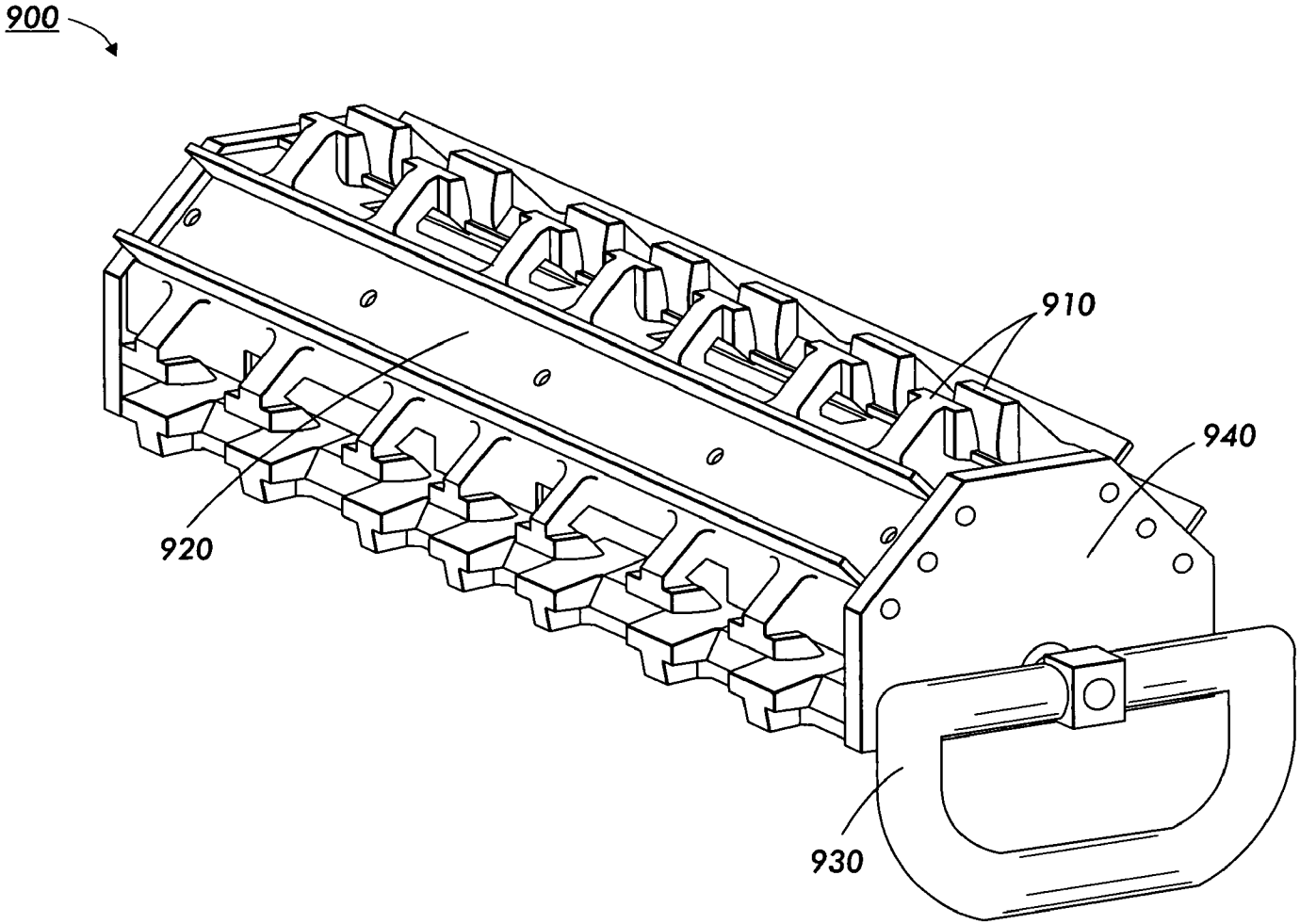
FIG. 9 is a three-dimensional rendering of an example embodiment of the jam clearance element.

Turning now to FIG. 9, there is illustrated a perspective view of an example embodiment of jam clearance element 900. In this embodiment the spatial relationship of baffles 920 and the director element (not shown) is maintained by opposing end caps 940. End caps 940 also provide pivotal support for articulating tips 910. Handle 930 is attached to one of end caps 930 to enable rotation of the jam clearance element and extraction of it from the machine. Media captured by the jam clearance element are spindled onto the jam clearance element until the entire media sheet is wrapped around the external surfaces of baffles 920. The jam clearance element is then removed from its frame support and the media is extracted by unrolling and pulling the media parallel to the process direction. Nip baffles 920 and articulating tips 910 may be fabricated from materials known in the art, for example, an injection molded plastic with bent metal reinforcing elements.

Figure 10:
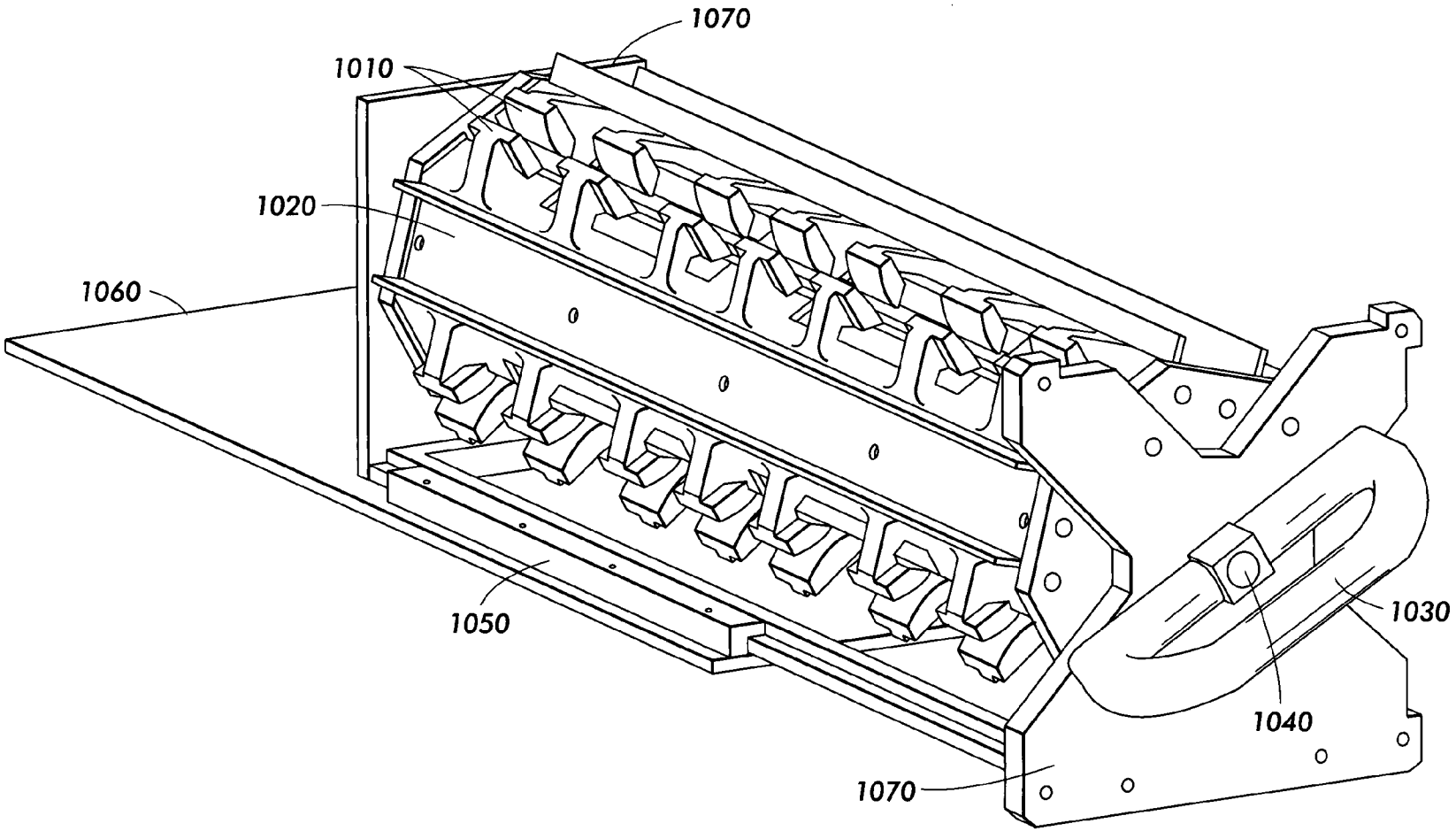
FIG. 10 is a three-dimensional rendering of another example embodiment of a jam clearance element assembly.

FIG. 10 illustrates features of another example embodiment for the jam clearance apparatus, which include the jam clearance element with an example supporting frame structure. In this embodiment the jam clearance element includes articulating tips 1010, side baffles 1020, and end cap 1070. The spatial relationship of baffles 1020 and the director element (not shown) is maintained by opposing end caps 1070. End caps 1070 also provide pivotal support for articulating tips 1010. Handle 1030 is attached to one of end caps 1070 through rotational support structure 1040 to enable rotation of the jam clearance element and extraction of it from the machine. Media captured by the jam clearance element are spindled onto the jam clearance element by rotating handle 1030 until the entire media sheet is wrapped around the external surfaces of baffles 1020. The jam clearance element is then removed from frame support 1060 by pulling handle 1030 outward from the machine such that the element glides on sliding support 1050. The media is extracted by unrolling and pulling the media parallel to the process direction. Nip baffles 1020 and articulating tips 1010 may be fabricated from materials known in the art, for example, an injection molded plastic with bent metal reinforcing elements. Frame support 1060, sliding support 1050, and rotational support 1040 may comprise any substantially rigid structure that provides support for the components of the jam clearance element.

While the present discussion has been illustrated and described with reference to specific embodiments, further modification and improvements will occur to those skilled in the art. For example, FIG. 8 describes an embodiment wherein the nip assemblies and jam clearance elements are supported on extruded posts attached to a rigid plate, both the posts and plate having features with which to align the nip assemblies and jam clearance elements. However, other support structures may be used, such as one fabricated from sheet metal or plastic front and back plates with sheet metal posts. Alignment and attachment features could be incorporated in the front and back plate elements. Sheet confining walls or baffles may be included to assist in media extraction during the cross process motion. Additionally, the jam clearance element may include any of various known means for grabbing or jamming the sheet to prevent the sheet from sliding out of the core as the core is rotated. Alternatively, a powered nip assist may be utilized in clearing sheet media from the jam clearance element. This may be achieved by driving the various nips in contact with the sheet media in accordance with the angular rotation of the core. It is to be understood, therefore, that this disclosure is not limited to the particular forms illustrated and that it is intended in the appended claims to embrace all alternatives, modifications, and variations which do not depart from the spirit and scope of the embodiments described herein.

What is claimed:

1. A rotatable, removable media path jam clearance apparatus adapted for installation in a substantially rigid supporting structure, the apparatus comprising:

at least one media drive mechanism for moving flexible media through at least one media path; and a jam clearance element, wherein said jam clearance element comprises:

at least two guide elements having facing surfaces, wherein said facing surfaces define guide surfaces for at least one media path, said guide elements further having external surfaces capable of supporting said flexible media as it is wrapped around said external surfaces;

pivotal support means including a rotatable element for rotational movement of said jam clearance element within the substantially rigid supporting structure; and a movable element for translational movement of said jam clearance element substantially perpendicular to the processing direction to provide at least partial extraction of said jam clearance element from the substantially rigid supporting structure.

2. The media path jam clearance apparatus according to claim 1, wherein said facing surfaces define at least two media paths, said guide elements comprising:

a media path director element having a plurality of guide surfaces, said media path director including access means for providing access of media to media paths; and a plurality of baffles, wherein each of said baffles has a guide surface facing a guide surface of said media path director element to define at least one media path, and further having at least one external surface capable of supporting said flexible media as it is wrapped around said external surface.

3. The media path jam clearance module according to claim 1, wherein said media drive mechanism comprises at least two pinch rollers and at least two opposing nip baffle pairs.

4. The media path jam clearance module according to claim 3, wherein the two parts of each said nip baffle pair are interdigitated.

5. The media path jam clearance module according to claim 3, wherein said nip baffle pairs are retractable.

6. The media path jam clearance module according to claim 3, wherein each said nip baffle pair is interdigitated with the mating parts of at least one of said media path director elements.

7. The media path jam clearance module according to claim 1, further comprising media state sensors.

8. The media path jam clearance module according to claim 2, wherein said access means comprises articulating tips.

9. The media path jam clearance module according to claim 1, wherein said media drive mechanism comprises at least one member selected from the group consisting of spherical nip actuators, piezoelectrically driven brushes, and airjets.

10. The media path jam clearance apparatus according to claim 1, wherein said facing surfaces define at least three media paths.

11. The media path jam clearance module according to claim 1, wherein said rotatable element comprises a shaft.

12. The media path jam clearance module according to claim 1, wherein said pivotal support means further comprises a handle.

13. A media handling system including at least one media handling module, a plurality of input modules, a plurality of output modules, and a plurality of media path jam clearance apparatuses adapted for installation in a substantially rigid supporting structure, wherein each of the plurality of media path jam clearance apparatuses comprises:

at least one media drive mechanism for moving flexible media through at least one media path; and a jam clearance element, wherein said jam clearance element comprises:

at least two guide elements having facing surfaces, wherein said facing surfaces define guide surfaces for at least one media path, said guide elements further having external surfaces capable of supporting said flexible media as it is wrapped around said external surfaces;

pivotal support means including a rotatable element for rotational movement of said jam clearance element within the substantially rigid supporting structure; and a movable element for translational movement of said jam clearance element substantially perpendicular to the processing direction to provide at least partial extraction of said jam clearance element from the substantially rigid supporting structure.

14. The media handling system according to claim 13, wherein said facing surfaces define at least two media paths, said jam clearance element further comprising:

a media path director element having a plurality of guide surfaces, said media path director including access means for providing access of media to media paths; and a plurality of baffles, wherein each of said baffles has a guide surface facing a guide surface of said media path director element to define at least one media path, and further having at least one external surface capable of supporting said flexible media as it is wrapped around said external surface.

15. The media handling system according to claim 14, wherein said media drive mechanism comprises at least two pinch rollers and at least two opposing nip baffle pairs.

16. The media handling system according to claim 15, wherein the two parts of each said nip baffle pair are interdigitated.

17. The media handling system according to claim 15, wherein said nip baffle pairs are retractable.

18. The media handling system according to claim 15, wherein each said nip baffle pair is interdigitated with the mating parts of at least one of said media path director elements.

19. The media handling system according to claim 14, further comprising media state sensors.

20. The media handling system according to claim 14, wherein said access means comprises articulating tips.

21. The media handling system according to claim 13, wherein said media drive mechanism comprises at least one member selected from the group consisting of spherical nip actuators, piezoelectrically driven brushes, and airjets.

22. The media handling system according to claim 13, wherein said facing surfaces define at least three media paths.

23. The media handling system according to claim 13, wherein said rotatable element comprises a shaft.

24. The media handling system according to claim 13, wherein said pivotal support means further comprises a handle.

25. A method for operating a rotatable, removable media path jam clearance apparatus adapted for installation in a substantially rigid supporting structure, wherein the media path jam clearance apparatus includes at least one jam clearance element, at least one media drive mechanism and guide baffles, the method comprising:

driving at least one unit of flexible media through at least one media path located within the media path jam clearance element, wherein said media path is defined by at least two guide elements having facing surfaces defining said media path and external surfaces capable of supporting said flexible media as it is wrapped around said external surfaces;

retracting the guide baffles to a position sufficient to prevent interference of the guide baffles with rotational movement of the jam clearance element within the substantially rigid supporting structure;

causing rotational movement of the jam clearance element about pivotal support means within the substantially rigid supporting structure when said flexible media has become jammed in said media path, such that said captured unit of flexible media is wrapped around said external surfaces; and causing translational movement of the jam clearance element substantially perpendicular to the processing direction to provide at least partial extraction of the jam clearance element from the substantially rigid supporting structure.

* * * * *